US008291660B2

(12) United States Patent
McCary

(10) Patent No.: US 8,291,660 B2
(45) Date of Patent: Oct. 23, 2012

(54) RADIANT INSULATING, VENTING AND MOISTURE CONTROL ASSEMBLY

(76) Inventor: John M. McCary, Birmingham, AL (US)

( * ) Notice: Subject to any disclaimer, the term of this patent is extended or adjusted under 35 U.S.C. 154(b) by 0 days.

(21) Appl. No.: 12/923,972

(22) Filed: Oct. 19, 2010

(65) Prior Publication Data

US 2012/0090266 A1 Apr. 19, 2012

(51) Int. Cl.
*E04B 1/70* (2006.01)
*E04F 17/00* (2006.01)

(52) U.S. Cl. ..... 52/302.3; 52/408; 52/169.5; 52/169.14

(58) Field of Classification Search ..... 52/302.1, 52/302.3, 302.6, 408, 413, 169.14, 506.01; 428/188

See application file for complete search history.

(56) References Cited

U.S. PATENT DOCUMENTS

| | | | | | |
|---|---|---|---|---|---|
| 2,662,043 | A * | 12/1953 | Clements | 428/120 |
| 3,574,109 | A * | 4/1971 | Yoshikawa | 428/152 |
| RE30,254 | E * | 4/1980 | Rasmussen | 160/84.02 |
| 4,199,636 | A * | 4/1980 | Clark | 428/114 |
| 4,840,515 | A * | 6/1989 | Freese | 405/45 |
| 4,943,185 | A * | 7/1990 | McGuckin et al. | 405/45 |
| 5,270,092 | A * | 12/1993 | Griffith et al. | 428/69 |
| 5,692,348 | A * | 12/1997 | Ambrosino | 52/169.5 |
| 5,902,432 | A * | 5/1999 | Coulton et al. | 156/199 |
| 5,918,436 | A * | 7/1999 | Alderman | 52/407.3 |
| 6,857,238 | B2 * | 2/2005 | Alderman | 52/407.3 |
| 7,425,515 | B2 * | 9/2008 | Fellinger et al. | 442/34 |
| 7,908,801 | B2 * | 3/2011 | Nielsen et al. | 52/169.5 |
| 2003/0126810 | A1 * | 7/2003 | Brunson et al. | 52/169.5 |

FOREIGN PATENT DOCUMENTS

GB 2281322 A * 3/1995

* cited by examiner

*Primary Examiner* — Brian Glessner
*Assistant Examiner* — Adriana Figueroa

(57) ABSTRACT

The present invention comprises an effective manufactured insulation and ventilating assembly that can insulate a structure, usually in roofing or exterior wall applications, from conductive, convective and radiant heat. The radiant insulating and venting assembly is comprised of an upper layer of a synthetic roof underlayment style partially flexible material that is moisture resistant. The bottom layer of the assembly is made up of a radiant reflective surface. Between the upper moisture resistant layer and the radiant reflective layer are air spacer columns, approximately ⅝ths to 1 inch in length, that create the needed air space for effective radiant heat reflection and air and moisture venting.

4 Claims, 3 Drawing Sheets

RADIANT INSULATING, VENTING AND MOISTURE CONTROL ASSEMBLY

BACKGROUND OF THE INVENTION

Figure 1:
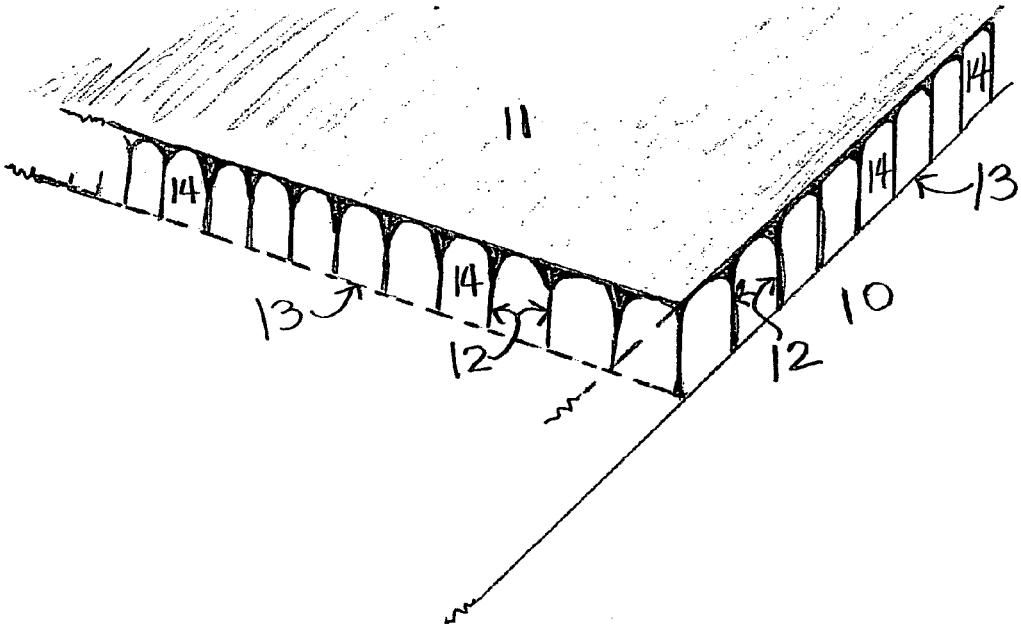

Roofs and walls of a building or structure must deal with various environmental and interior building factors such as heat insulation, proper venting and moisture control. The design of the roof and wall systems need to be structurally sound while providing for a habitable temperature living space. There are three sources of heat that affect the ability of a building structure's insulation to control heat transfer. The "insulation" or heat control of the temperature controlled space may be broadened to include dealing with moisture.

Convective heat transfer is the movement of air either naturally as in where hot air rises displacing the cold air (moves the cold air down), or the mechanical convection when air is physically moved such as by a fan. Convective heat movement accounts for about 15 to 20% of heat loss/transfer (air leakage) through exterior walls.

Conductive heat is the transfer of heat energy from one object by touch to another object. Thermal bridging of solid studs in a wall is an example of conductive heat loss bridging between external face covering to interior wall covering.

Radiant heat is the absorption of radiant energy emitted by a heated object. Approximately 60 to 75% of total heat transfer in a residence or building occurs through radiation, can be as much as 90% heat gain in the attic/ceiling in the summer time.

Improper venting and moisture control can impact the ability of the wall or roof system to control heat (insulation saturation with moisture and collapse) and to maintain the structural integrity of the building (rot, decay, or insects). Moisture control and drainage in the exterior wall is critical in certain applications such as brick and stucco where there may be through face leakage.

Heat insulation material placed in/or part of walls, ceiling, roofs, floors and other "wall structures" have historically been comprised of fibrous blanket insulation, such as fiberglass or foam insulation board. The principle of the blanket insulation is to form dead air spaces that provide insulation against convection and conduction heat transfer. The blanket insulation can be formed in small "clumps" and blown into spaces such as into the attics of residential homes and other building structures, and can also be made into elongated blankets formed in a specific width and depth that is suitable for placement between parallel joist, studs, rafters, and other parallel support structures that are uniformly spaced apart.

Foam insulation board is usually placed on the exterior sheathing surrounding the structure and is a good insulator against conductive and convective heat transfer. Foam insulation board is usually made up of extruded or pressed sheets made of expanded polystyrene (EPS), extended polystyrene (XPS), and polyisocyanurate (polyiso). Rigid foam board insulation provides high R-value with minimum thickness; low weight allows for easier installation and shipping cost; energy required to produce polystyrene foam insulation is 24 percent less than the energy required to make the equivalent R-value of fiberglass insulation (green product); High resistance to mold.

In the recent past, an additional sheet of reflective material has been applied to one of the broad surfaces of the fibrous blanket and foam insulation board. The radiant reflective surface can be effective in reflecting radiant heat if the reflective surface faces the source of the radiant heat and there is an approximately a ¾ inch air space between the reflective surface and another surface.

Radiant reflective insulation can be as simple as aluminum foil to multiple layered assemblies such as foil-bubble-foil with foam insulation possibly added as a layer. The reflective material, such as aluminum reflective insulation, can functions as a barrier to radiant heat transfer when applied in the right location and having the needed air space between the reflective surface and another material. Reflective insulation has many benefits: very thin; can be stabled and glued; easy to cut; does not promote mildew, mold, or fungus growth; reflective insulation can have, when applied correctly, a higher R-value than most other type of insulation. A ¼ inch of reflective insulation has more insulation than 6 inches of common fiberglass bat.

But most of the radiant reflective insulation on the market today does not address one of the major requirements for effective radiant reflection. One of the problems or inefficiencies of many of the radiant reflective applications is that when reflective surfaces of the foil engage another surface, such as the fiberglass of an adjacent insulation blanket or the adjacent gypsum, foam board or other wall structure, such as siding, the foil looses a considerable amount of its ability to reflect heat (air space requirement). The reflective side of the radiant insulation needs to face the source of the radiant energy to effectively reflect back radiant heat. When radiant reflective material touches or is too close to a solid object much of the radiant heat is converted to conductive heat. Also the less material the reflected back radiant energy has to move through the better the total percentage amount that radiant heat is transferred out of the area being temperature controlled.

Another problem with the use of reflective surface on combination with other insulation materials is that the surface should become dirty from an accumulation of dust, trash, fibers, vapors, etc., the reflective sheet loses its ability to reflect radiant heat. There needs to be a protective covering spaced apart from the reflective surface.

One of the most significant factors that can limit the effective use of the current radiant reflective insulation is that they collapse or compress when roofing, wall siding or other hard material is applied resulting in inefficient radiant heat reflection. In most of the current radiant insulation manufactured assemblies the air space is usually not wide enough for effective radiant heat reflection and any compression on their surface further reduces the needed radiant air space.

Currently, there is not a manufactured radiant insulation and venting assembly that: has the approximately ¾ inch reflective air space that can be used for air and moisture venting; is in a sheet or roll form; has none collapsible "spacers" that hold the top protective and/or moisture resistant synthetic underlayment style surface spaced apart from the lower reflective surface, under siding, roofing or other hard surface applications. The product or system needs to be cost effective, of good quality, available, fairly easy to apply and environmentally sound

SUMMARY OF THE INVENTION

Briefly described, the present invention comprises an economical and effective heat insulation assembly that can assist in the insulating the structure from radiation heat transfer through walls, roofs or in other radiant reflective applications. The radiant insulation configuration can also assist with air and moisture venting. The radiant insulating and venting assembly is comprised of a synthetic underlayment style material top or upper protective moisture resistant layer. None collapsing spacers or columns are adhered to the underside of the moisture resistant outside layer and to a lower radiant reflective layer. The moisture resistant upper layer is held separated, approximately ¾ inch, from the bottom reflective layer by the spacers columns, creating the needed air space for effective radiant reflection. When the radiant insulating assembly is used for roofing and wall siding or resurfacing the upper or outer layer is acts like a synthetic roof underlayment where the upper layer repels any moisture as a water barrier and the spacers maintain the air space for radiant heat reflection and possibly venting of air and moisture. The vented air under the roofing may also assist in extending the useful life of the roofing material.

The radiant insulating and venting assembly for some applications may bend enough to be rolled up for handling and shipping. The composition of the moisture resistant upper layer in conjunction with the stiffness of the spacers will not allow the upper or outward layer to overly indent or crack when roofing or siding is applied. The spacer columns need to be stiff enough to maintain the radiant/venting air space even under some loading and usual roof foot traffic. The spacers are also designed where a small portion of the spacer touches the reflective surface allowing the majority of the surface to effectively reflect radiant heat. The top protective an water resistant layer helps protect the reflective surfaces of the reflective sheet from the accumulation of dirt, dust, insulation fiber, vapor and other things that would occlude or diminish the reflective properties of the reflective surface of the reflective sheet.

The air spaces of the radiant insulating and venting assembly can also be used, in conjunction with effective radiant heat reflection, to vent air and to allow moisture to be removed or evaporated. This can be very useful in geographic areas where there are high levels of exterior moisture and warm temperatures or in colder areas with varying interior/exterior temperatures and moisture levels. If moisture is not controlled then rot, interior wall freezing, mold, mildew and other complications can occur including reduction in insulation effectiveness.

BRIEF DESCRIPTION OF THE INVENTION

FIG. 1. Shows in a perspective side cross sectional view the components of the radiant insulating and venting assembly.

Figure 2:
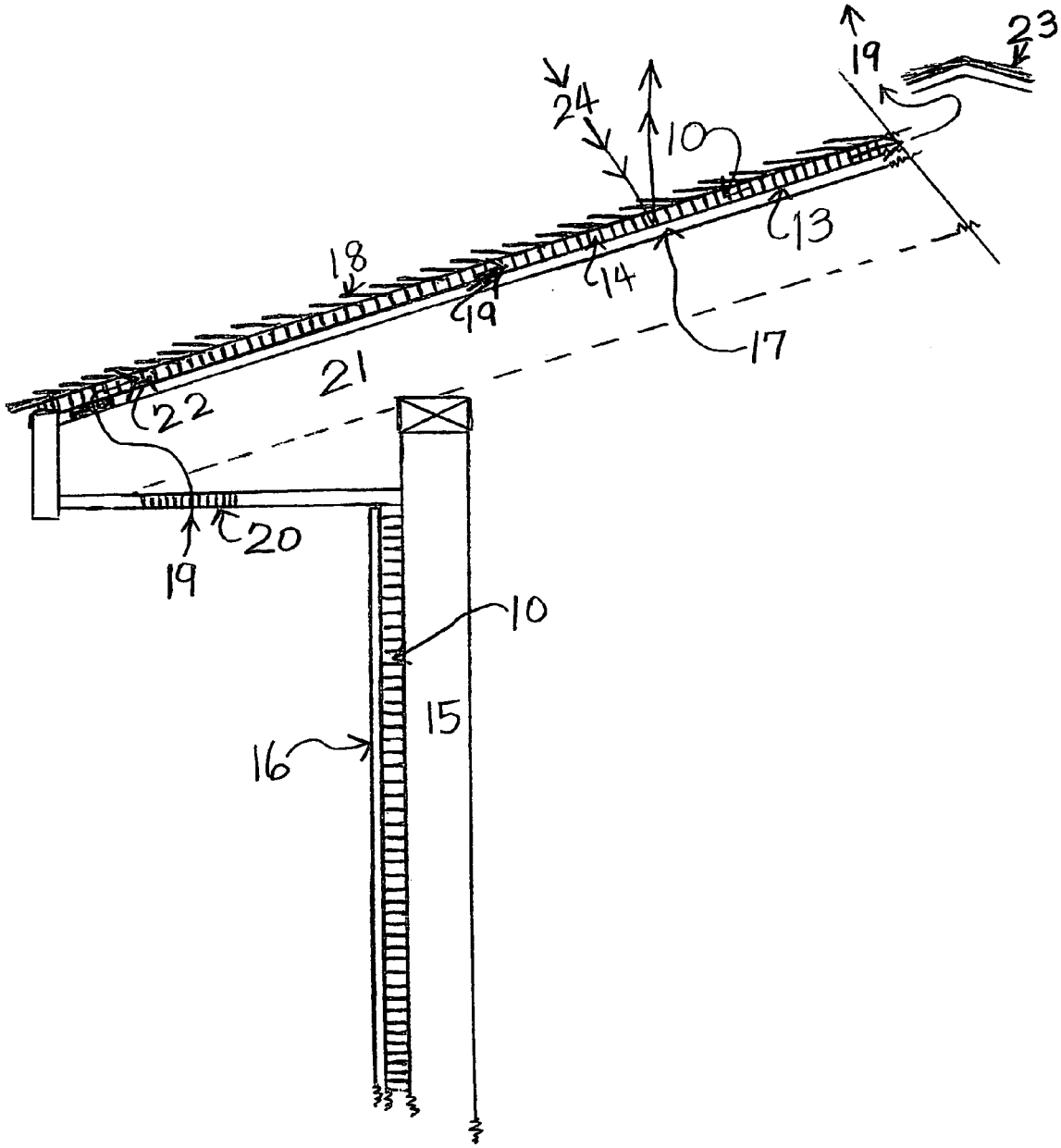

FIG. 2. Demonstrates in a side cross sectional view the radiant insulating and venting assembly is being applied in a wall assembly and in a roofing application.

Figure 3:
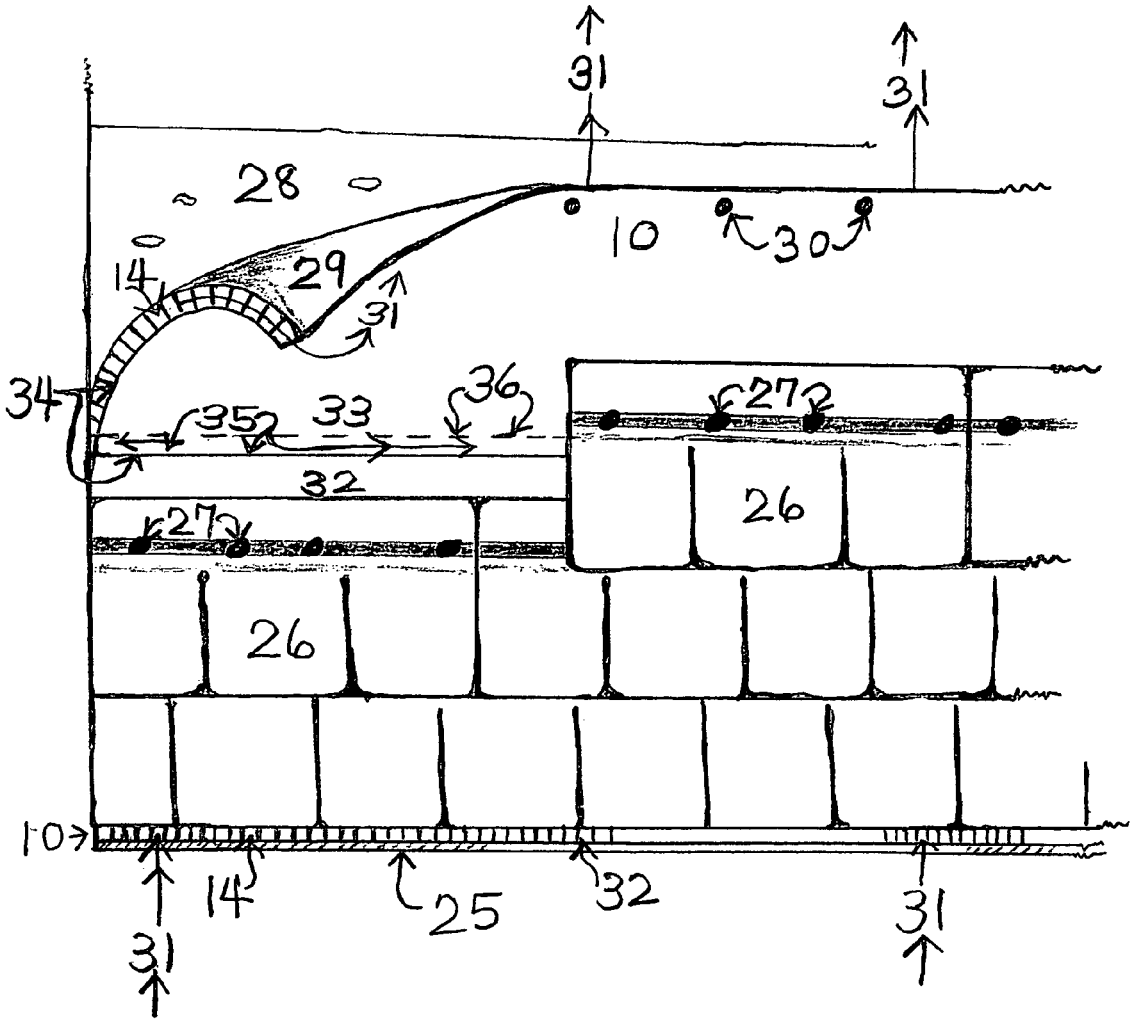

FIG. 3. Shows more closely in a perspective view the radiant insulating and venting assembly used in a roofing application.

DETAILED DESCRIPTION OF THE PREFERRED EMBODIMENTS

Shown in FIG. 1. in a perspective side cross sectional view are the manufactured radiant insulating and venting assembly 10 components. Shown is the protective moisture resistant layer 11 with the none collapsing air spacers 12 adhered between the moisture resistant layer 11 and a radiant reflective layer 13. The air spaces 14 are created by the cavities between the air spacers 12 and the upper moisture resistant layer 11 and the reflective layer 13.

Demonstrated in FIG. 2. in a side cross section view is the radiant insulating and venting assembly 10 being used to radiantly insulate an exterior wall structure with wall studs 15 and wall covering 16 adhered through the radiant insulating assembly 10. Also demonstrated in FIG. 2. is the rolled radiant insulating and venting assembly 10 applied on roof decking 17 under roofing material 18. Air 19 coming into the soffit eave vent 20 at the lower end of the roof rafters 21 is pulled up into the venting air spaces 22 of the manufactured radiant insulating and venting assembly 10 and up out of the ridge vent 23 at the top of the roof 18. The radiant reflective layer 13 reflects back radiant heat 24 made effective by the created air spaces 14.

FIG. 3. shows more closely, in a perspective view, the radiant insulating and venting assembly 10 used in a roofing application. Shown at the edge of the roof decking eve 25 is the radiant insulating assembly 10 with air spaces 14. Roofing 26 is shown applied with nails 27 over the radiant insulating assembly 10. The upper roof decking 28 is shown is shown with rolled back radiant insulating assembly 29 that is being applied by nails 30 to the roof decking 28. Air 31 comes up from the lower eve radiant insulating assembly rolled out section 32 through air spaces 14 and the vented air continues to move up to the next upper radiant insulating assembly section 33. The lower edge of the water resistant top layer 34 of the radiant insulating assembly 10 has an overlap 35 which is an extension of the water resistant upper layer 34 that overlaps the adjoining edge top layer of the adjacent section of radiant insulating assembly 36. The overlap 35 assists in sealing out any water leaking through the roofing 26 and to run off the roof so as to not penetrate into the roof decking 28.

The preferred methods of application of the manufactured radiant insulating and venting assembly as described above are when the radiant insulating assembly is used to insulate upon the top of roof decking or on the exterior side of wall assemblies. In the roofing insulation application the radiant insulating assembly is placed upon the decking and secured down either by nailing, screwing, adhesives or a peel and stick adherence method. The radiant insulating and venting assembly is usually in a rolled form for roof applications but may be in sheet form.

Roofing is usually applied by nailing or screwing through the radiant insulating assembly and into the roof decking. The radiant insulating assembly may be used in lower sloped roof application where the radiant insulating and venting assembly is usually applied with adhesives. In the sloping roof application the air spaces created by the spacers allow vented air to flow between the protective layer to usually move upward but in either low or more sloping roof applications radiant heat is reflected back outward by the reflective surface of the radiant reflective layer.

In the wall application the radiant insulating and venting assembly is usually adhere to the exterior side of a wall structure either in rolled or sheet form and may be applied by nailing, screws, adhesives or a peel and stick method. The created air spaces help to evaporate moisture and the reflective layer reflects radiant heat back outward to the exterior and in some geographic application the interior side of the radiant insulating assembly's reflective layer is radiant reflective to reflect heat back to the interior.

In both the roof decking and the wall application the radiant insulating assembly may be manufactured adhered to other insulation such as foam or fibrous insulation and the radiant insulating assembly may not be covered with roofing or siding for an extended period of time. In some applications the radiant insulating assembly may act as either roofing or siding where the protective layer's exterior surface may have added UV protection and/or the exterior surface of the protective layer may be periodically coated to extend its usability.

In most configurations of the radiant insulating and venting assembly the upper moisture resistant layer may be extended on at least one edge to produce an overlap tab. The overlap may be used to extend over onto an adjoining abutting surface to assist in sealing out moisture and/or air and the overlap tab may be adhered to the adjoining surface.

The invention claimed is:

1. A manufactured one piece radiant insulating, venting and moisture vapor control assembly, comprising:

a. a first layer that is a partially flexible protective moisture resistant layer; and b. a second radiant reflective layer with a radiant reflective surface on the interior side facing the protective moisture resistant layer of the second reflective layer;

c. wherein said first moisture resistant layer and second reflective layer have an approximate ⅝ths to 1 inch cavity or air space there between that has periodic non-collapsing columns or spacers that are adhered between and keep separated the first protective moisture resistant layer from the second radiant reflective layer and air spacers touch approximately 10 to 15 percent of the reflective surface;

d. wherein said cavity or air space formed between the first moisture resistive layer and the reflective layer is designed to allow air and moisture vapor to flow into the open venting edges of the assembly flowing around said air spacers through the two layers of the assembly and out of the open venting edges of the radiant insulating and air and moisture vapor venting assembly and e. wherein the air space spacers touching the reflective surface of the second reflective layer minimizes conductive heat transfer and allows the radiant reflective surface with the needed ⅝ths to 1 inch air space facing the protective layer of the radiant reflective layer to effectively reflect 85 to 90 percent radiant heat back in the desired direction outward past the second moisture resistive layer;

f. wherein said protective moisture resistive layer in conjunction with the compression stability of the attached spacers between and attached to the protective moisture resistant layer and the radiant reflective layer will allow applied materials including roofing material and above grade wall coverings to be attached to or through the radiant insulating assembly, wherein the flexural strength of the protective layer and the lack of compression collapsing of the cavity spacers provides roofing or siding material when applied upon the radiant insulating assembly with the remaining capacity for effective radiant heat reflection, air and/or moisture venting;

g. wherein the radiant insulating assembly can be manufactured and applied in either rolled or sheet form.

2. A radiant insulating manufactured assembly according to claim 1, further being manufacture attached on either layer face to various forms of fibrous insulation or foam insulation.

3. A radiant insulating manufactured assembly according to claim 1, wherein the radiant insulating assembly is attached to either the exterior side of roof decking or to the exterior side of a wall structure, wherein said protective layer is UV treated or periodically recoated to allow the radiant insulating assembly to remain uncovered for an extended period of time.

4. A radiant insulating manufactured assembly according to claim 1, wherein the edges of the upper moisture resistant protective layer is extended past the air spacers and the radiant reflective layer so as to be an overlapping tab upon an adjacent abutting surface to help seal out moisture and air coming through the protective moisture resistive layer between an adjoining overlapped surface.

* * * * *